United States Patent [19]

Ibrahim

[11] 4,352,275

[45] Oct. 5, 1982

[54] REMOVABLE DUCT PANEL FOR MULTIBAND OPEN FRONT DISPLAY CASE

[75] Inventor: Fayez F. Ibrahim, Niles, Mich.

[73] Assignee: Tyler Refrigeration Corporation, Niles, Mich.

[21] Appl. No.: 258,326

[22] Filed: Apr. 28, 1981

Related U.S. Application Data

[63] Continuation-in-part of Ser. No. 221,375, Dec. 30, 1980, abandoned, which is a continuation of Ser. No. 76,568, Sep. 18, 1979, abandoned.

[51] Int. Cl.[3] ..... A47F 3/04

[52] U.S. Cl. ..... 62/256

[58] Field of Search ..... 62/255, 256, 285, 286, 62/288, 282

[56] References Cited

U.S. PATENT DOCUMENTS

| | | | |
|---|---|---|---|
| 2,725,726 | 12/1955 | Swanson | 62/256 X |
| 3,319,557 | 5/1967 | Perez | 62/256 X |
| 3,358,467 | 12/1967 | Hickox et al. | 62/256 |
| 3,675,440 | 7/1972 | Ibrahim | 62/255 |

*Primary Examiner*—Lloyd L. King

*Attorney, Agent, or Firm*—LeBlanc, Nolan, Shur & Nies

[57] ABSTRACT

A refrigerated display case comprising an outer cabinet having a bottom portion which slopes downwardly to form a drain region for collecting fluid material by gravity flow and a product display space within and spaced from the outer cabinet; one or more circulation conduits having an outlet opening and inlet opening on opposite sides of the cabinet access opening are defined between the outer cabinet and the walls of the display space. The conduits are further defined by a first relatively fixed bottom panel member and a second removable panel member. One end of the second panel member is loosely supported on the first bottom panel member. Support means are provided for loosely supporting the second panel member on the bottom portion of the cabinet in spaced relation thereto. A removable bottom shelf defines the bottom of the display space and is loosely supported above and in spaced relation to the second panel member. The bottom shelf and second panel member are easily removable to permit access to the drain region of the cabinet.

14 Claims, 3 Drawing Figures

REMOVABLE DUCT PANEL FOR MULTIBAND OPEN FRONT DISPLAY CASE

CROSS REFERENCE TO RELATED APPLICATIONS

This is a continuation-in-part of my copending application Ser. No. 221,375 filed Dec. 30, 1980 now abandoned and entitled REMOVABLE DUCT PANEL FOR MULTIBAND REFRIGERATED DISPLAY CASES, which is, in turn, a Rule 60 continuation of Ser. No. 76,568 filed Sept. 18, 1979, now abandoned. The disclosures of those prior two applications are hereby incorporated by reference as though fully set forth herein.

BACKGROUND OF THE INVENTION

This invention relates to refrigerated display cases, and more particularly to open dislay cases having multiple air bands flowing across the access opening of the case. Still more particularly, the invention is directed to a case having easily removable panels in the storage/-display section.

This invention is primarily, but not exclusively, directed to refrigerated display cases of the type usually found in supermarkets, convenience stores, etc. One popular case style has an open product display area protected by one or more air bands circulated across the customer access opening. Such cases may either be of the open top type, as shown in U.S. Pat. No. 4,106,305, issued to Fayez Abraham and assigned to Tyler Refrigeration Corporation, or the open front type, as shown, for example, in U.S. Pat. No. 4,144,720 issued to Elmer Subera, Melvin Steelman, and Fayez Abraham, and assigned to Tyler Refrigeration Corporation.

It should be noted that throughout this disclosure, except where specifically indicated otherwise, the term "refrigerated case" refers to medium temperature cases (e.g. case temperatures maintained in the 32°-50° F. range) and low temperature freezer cases (case temperature maintained below 32° F.).

Commercial refrigerated display cases must be maintained with a high degree of cleanliness, both to meet local health code requirements and to present a favorable appearance to the customer. Thus the display cases, and particularly the product storage area, must be cleaned at frequent intervals. Cases which are used for the storage and display of certain types of goods, particularly including meat and poultry products and vegetable products, which are generally of the medium temperature type, generally require more frequent cleanings than, for example, dairy cases and frozen food display cases.

In the past, cleaning the display case was a difficult chore, often requiring the services of trained maintenance personnel to dismantle at least a portion of the case so that the area underneath the bottom display shelf could be cleaned. Heretofore, display cases were constructed in such a way that it was necessary to unbolt or unscrew a number of parts including, for example, the bottom display shelf and the intermediate duct separator panel in order to get access to the main case drain or waste outlet. Such access is necessary, particularly in meat or poultry cases, to clean blood or other juices which leak from the packages and collect in areas underneath the display shelf.

It is an object of the present invention to provide a case construction which permits ready access to the portion of the case below the display area.

A further object is to provide a construction which permits ready access to the waste outlet area beneath the case for cleaning and/or clearing of the outlet.

A further object is to provide a case construction which enables portions of the display case to be readily removed without special tools.

SUMMARY OF THE INVENTION

This invention is directed to a multiband refrigerated display case composed of an outer cabinet and inner cabinet having an open product display space therein. A divider is located between the inner and outer cabinets for dividing the space between the cabinets into adjacent first and second conduits. The divider comprises a first relatively fixed bottom panel member and a second removable panel member. The first bottom panel member has a U-shaped region for loosely supporting one end portion of the second panel member. Means are provided for supporting the second panel member on the bottom of the outer cabinet in spaced relation thereto. A removable bottom shelf defining the bottom of the inner cabinet and display space and inlet grill means are loosely supported above and in spaced relation to the removable second panel member.

In one embodiment, the second removable panel member comprises a main body portion contiguous with and extending at an angle to the one end portion; an opposite end portion extends from the main body portion at an angle thereto. The grill support comprises a plurality of members secured to the upper surfaces of the main body portion and the opposite end portion of the second panel member and had substantially L-shaped grill support faces. The inlet has a substantially complementary L-shaped portion adapted to seat loosely on the L-shaped grill support faces. The removable bottom shelf is supported by a lip extending from the inlet grill into the display space when the inlet grill is in its operative position resting on the grill support; the inner cabinet has an opposed lip for supporting an opposite edge portion of the removable bottom shelf.

A second embodiment of the display case according to this invention comprises a third relatively fixed panel member, spaced from and located on the opposite side of the drain region from the first bottom panel member; quick release means secure the second panel member to the third panel member, to permit the second panel member to be easily removed for access to the drain region.

DESCRIPTION OF PREFERRED EMBODIMENTS

Figure 1:
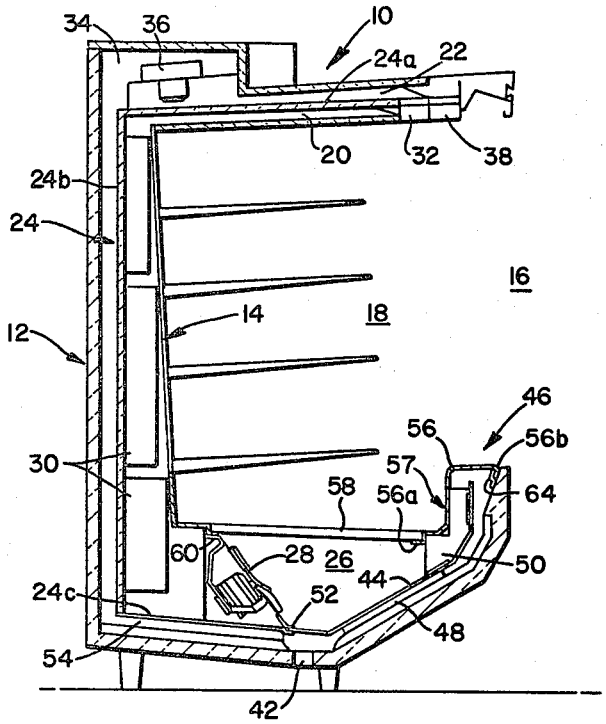
FIG. 1 shows a side sectional view of an open front refrigerated display case incorporating features of this invention.

FIG. 1 shows an open front refrigerated display case 10 having an outer cabinet 12 and an inner cabinet 14, each having an open front which are aligned to define a customer access opening 16 to a product display/storage section 18 defined within inner cabinet 14. The space between the outer cabinet 12 and inner cabinet 14 is preferably and advantageously divided into an inner air conduit 20 and outer air conduit 22 by an intermediate divider generally designated 24.

The inner conduit 20 is comprised in part of a plenum 26 containing one or more primary band fans 28. One or more sets of evaporator coils 30 are located in the primary band conduit 20 downstream (in the direction of refrigerated air flow) of the fans 28. The coils 30 are preferably and advantageously connected to centrally located refrigeration machinery, in a manner well known in the art. An outlet grid 32, preferably and advantageously of the honeycomb type, is located at the outlet of primary band conduit 20 to direct air flow across the access opening 16 (downwardly in the case of the open front display cabinet shown in the drawing).

The outer conduit 22 comprises, in part, a plenum 34 containing one or more air propelling fans 36. A grid 38, which may be similar to or an extention of honeycomb grid 32, is located at the outlet of conduit 22 to direct air across the access opening 16.

As shown in FIG. 1, the bottom portion of the refrigerated case 10 slopes downwardly toward a relatively centrally located drain region 40 in which is located a waste outlet drain 42.

The primary-secondary conduit divider 24 comprises a top member **24*a*, a back member 24*b* and a bottom member 24*c* contiguous with each other. Portions 24*a* and 24*b* may advantageously and preferably be insulated to minimize heat transfer between the relatively cold air in conduit 20 downstream of the evaporators 30 and the relatively warmer unrefrigerated air in conduit 22. A removable duct separator panel 44 also comprising part of divider 24, extends forwardly and upwardly from member 24*c* toward an air inlet region 46**.

Figure 2:
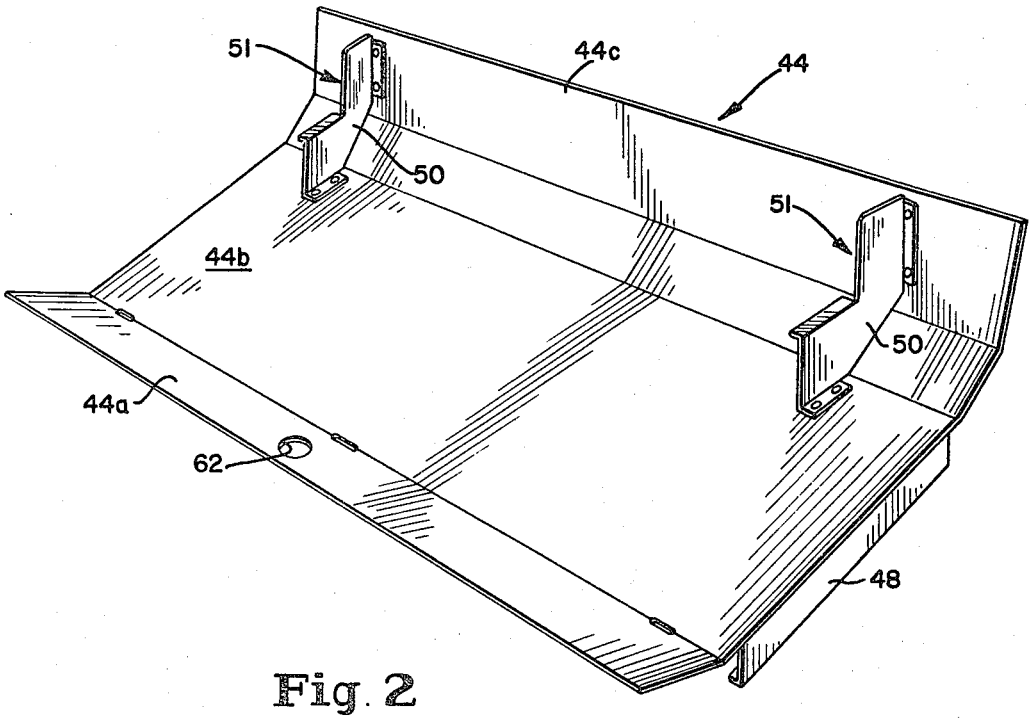
FIG. 2 is a perspective view of the removable duct separator panel of this invention.

As shown in more detail in FIG. 2, separator panel 44 comprises a leading edge portion **44*a*, a main body portion 44*b*, and a generally upwardly extending trailing edge portion 44*c*; section 44*c* may have an intermediate bend as shown and as necessary to conform to the desired shape of the ducts. Leg members 48 (only one being shown) mount securely to the underside of panel section 44*b*. A plurality of grid support members 50 (two of which are shown in FIG. 2) preferably and advantageously mount to the upper surfaces of panel sections 44*b* and 44*c*. Support members 50 preferably have substantially L-shaped support faces 51**.

The forward edge of bottom member **24*c* preferably and advantageously comprises a U-shaped region 52. This U-shaped region 52 may comprise a stamped integral part of the member 24*c* or may be a separate part rigidly secured by welding or riveting, to the end of member 24*c*. Also member 24*c* is securely fixed to and spaced from the bottom of the cabinet defining the outer wall of conduit 22 by means of legs 54 which may be similar to legs 48 supporting panel 44. Preferably, legs 54 are secured to both the panel member 24*c*** and to the case bottom.

The leading edge **44*a* of separator panel 44 seats in a groove formed by the legs of U-shaped region 52. Panel 44 is supported on and in spaced relation from the upwardly extending front portion of outer cabinet 12 by legs 48. Thus the inlet region of the outer or secondary band conduit 22 is defined between the panel 44 and upwardly extending front portion of cabinet 12**.

An air return grill 56, having a region 57 which is substantially L-shaped complementary to L-shaped portions 51 of support members 50, extends inwardly from the lower front edge of cabinet 12 and rests on the grill support members 50. Inlet grill 56 has one edge or lip portion **56*a* which extends slightly into the display region of the case at the bottom. A removable bottom display section shelf 58 rests on this lip 56*a* at its forward end. The rear edge of shelf 58 is supported in any known manner, such as by a corresponding lip 60, advantageously forming an integral part of the bottom portion of inner cabinet 14. Preferably and advantageously, grill 56 is not secured in any way to the cabinet 12 or support member 50; preferably grill 56 merely rests on support member 50 and is held in place by the weight of shelf 58**.

Access to the inside bottom of cabinet 12, and particularly to the drain region 40 and drain outlet 42, may be had quickly and easily, as follows: bottom shelf 58 is lifted off its supports **56*a* and 60. Inlet grill 56 may then be lifted off support members 50. Finally, separator panel 44 is then pulled forwardly and upwardly to unseat leading edge 44*a* from the grove of U-shaped region 52. Upon removal of panel 44, the entire drain region 40** is freely accessible e.g. for cleaning. Replacement of the various members is accomplished by reversing the steps outlined above to thereby return the case to its normal operating condition.

Panel 44 may, if desired, contain an opening 62, advantageously and preferably located over the drain outlet 42. Such opening will permit visual access to the drain outlet by only removing bottom shelf 58, without also requiring removal of the inlet grill 56 and separator panel 44.

When removable shelf 58 is resting on lips **56*a* and 60, the weight of shelf 58, particularly with food products resting thereon, exerts a force on lip 56*a* which would tend to cause inlet grill 56 to rotate inwardly and thereby cause shelf 58 to collapse. To prevent such rotation while still enabling grill 56 to be easily removed, one or more locking blocks 64 may be provided on the inner face of the outer cabinet 12 adjacent inlet region 46. A downwardly turned end portion 56*b* of inlet grill 56 mates with locking member 64 in a tongue and groove arrangement. In this manner the locking members 64 inhibit movement of the inlet grill 56 toward the interior of the display space into the storage/display section 18 while permiting relatively vertical upward movement of the grill 56** for removability.

Figure 3:
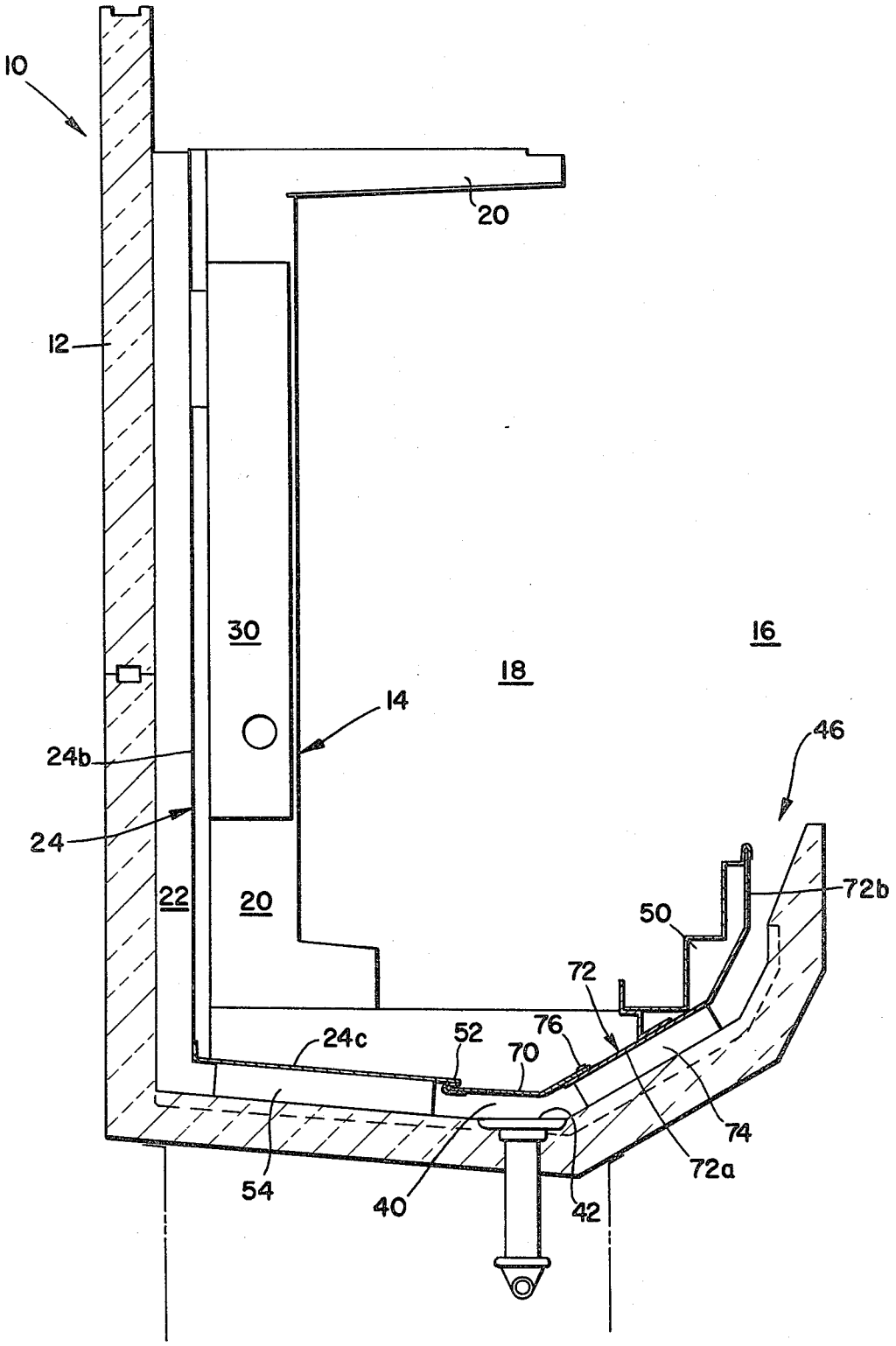
FIG. 3 is a side sectional view of a second embodiment of an open front refrigerated display case incorporating features of this invention.

FIG. 3 shows a second embodiment of the removable duct panel of the invention. This embodiment requires the removal of fewer parts to obtain access to the drain region at the bottom of the case. In the embodiments of FIGS. 1 and 3, like features are designated by the same reference numerals. For the sake of clarity and conciseness, certain features shown in FIG. 1 are omitted from FIG. 3 but are clearly intended to be incorporated into the embodiment shown in FIG. 3, as will be appreciated by one skilled in the design and construction of commercial refrigeration apparatus.

In this embodiment, removable panel 44 is replaced by two members 70 and 72. Member 72 has a main body portion **72*a* and a generally upwardly extending front edge portion 72*b*. Portion 72*b* may have an intermediate bend as shown to conform to the desired shape of the duct. Leg members 74 (only one being shown) mount securely to the underside of panel section 72*a* and to the case bottom, in like manner as legs 54 which mount bottom member 24*c* to the case bottom. Grid support members 50 mount to the upper surfaces of panel section 72***a* and 72*b*.

Conduit divider members 24 and 72 are located in the case so that the forward edge of bottom portion 24*c* of divider 24 and the trailing edge of main body portion 72*a* of divider 72 are spaced from each other so as to frame drain region 40 and permit ready access thereto. During normal refrigeration operations, member 70 bridges the gap between members 24 and 72 to cover drain region 40 and maintain the continuity of the intermediate divider between conduits 20 and 22. When in position, one side of bridging member 70 rests in the groove formed by the leg of U-shaped region 52. The opposite side of member 70, which may be bent upwardly to match the angle of member 72 rests on the trailing edge of main portion of 72*a* and is secured thereto by quick release fasteners 76.

Access to the inside bottom of cabinet 12, and particularly to the drain region 40 and drain outlet 42, may be had quickly and easily by lifting out the bottom shelf (as described above with respect to the embodiment of FIG. 1), thereafter releasing fasteners 76, and removing bridging member 70. The drain region 40 is now exposed for cleaning.

Bridging member 70 may in fact consist of two or more members, each running only a portion of the length of the case but together extending the entire length of the case. Such arrangement is advantageous in that if the case contains only a single drain 42, only a short section of panel 70 need be removed for access directly to the drain 42 for inspection and/or servicing. This arrangement also reduces or eliminates the necessity for a viewing opening, such as opening 62 shown in FIG. 2. Such an opening can permit mixing of the air between conduits 20 and 22, thereby reducing the efficiency of operation of the refrigerated case.

For convenience, the novel and advantageous features of this invention have been described with respect to an open front refrigerated case. It should be noted, however, that the invention may also be applicable to multiband open top cases of the type described, for example, in the present inventor's co-pending application Ser. No. 11,804, filed Feb. 14, 1979 and assigned to Tyler Refrigeration Corporation.

The invention may be embodied in other specific forms without departing from the spirit or essential characteristics thereof. The present embodiment is, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A refrigerated display case comprising:

an outer cabinet having a bottom portion which slopes downwardly to form a drain region for collecting fluid material by gravity flow;

an inner cabinet within said outer cabinet and spaced therefrom, said inner and outer cabinets having aligned access openings to permit access to the display space in the inner cabinet;

means intermediate said inner and outer cabinets for dividing the space between said cabinets into adjacent first and second conduits, each conduit having respective outlets and inlets on opposite sides of the aligned cabinet access openings, wherein said intermediate means for dividing the space between the inner and outer cabinets comprises a first relatively fixed bottom panel member and a second removable panel member;

air circulating means for propelling air through said first and second conduits between their respective inlets and outlets and across the aligned access openings between the respective conduit outlets and inlets;

means for refrigerating the air flowing through at least one of the first and second conduits;

means at one end region of the first bottom panel member for loosely receiving therein one end portion of the second panel member;

support means located on the underside of the second panel member for supporting said second panel member on the bottom portion of the outer cabinet in spaced relation thereto;

inlet grill means;

grill support means for loosely supporting said inlet grill means in a position to cover the first and second conduit inlets; and a removable bottom shelf defining the bottom of the inner cabinet and display space;

said inlet grill means including means for loosely supporting at least a portion of the removable bottom shelf.

2. A display case according to claim 1, wherein said means for loosely receiving one end portion of a second panel comprises a substantially U-shaped portion extending from one end of the first bottom panel member, said second panel member end portion being slidably receivable in the groove of the U-shaped portion.

3. A display case according to claim 1 or 2, further comprising means secured to the outer cabinet adjacent to the conduit inlets for restraining the inlet grill means against relatively lateral inward movement toward and into the display space while freely permitting relatively vertical upward movement of the inlet grill means.

4. A display case according to claim 1 or 2, wherein said second panel member includes means permitting visual observation of said drain region without removing said second panel member from its operational position loosely received by said first bottom panel member.

5. A display case according to claim 4, wherein said means permitting visual observation of the drain region comprises at least one through opening located in said one end portion of the second panel member.

6. A display case according to claim 1 or 2, wherein:

said second removable panel member comprises a main body portion contiguous with and at an angle to said one end portion and an opposite end portion extending from said main body portion at an angle thereto;

said grill support means comprises a plurality of members secured to the upper surfaces of said main body portion and said opposite end portion of said second panel member and having substantially L-shaped grill support faces;

said means for loosely supporting at least a portion of the removable bottom shelf comprises a lip extending from the inlet grill means into the display space when the inlet grill means is in its operative position resting on said grill support mean; and said inner cabinet has an opposed lip for supporting an opposite edge portion of the removable bottom shelf.

7. A refrigerated display case comprising:

a cabinet having a bottom portion which slopes downwardly to form a drain region for collecting fluid material by gravity flow, said cabinet having a product display space with an access opening to permit access to the interior of said display space;

means in said cabinet defining an air circulation conduit having an outlet opening and inlet opening on opposite sides of the cabinet access opening, said conduit defining means comprising a first relatively fixed bottom panel member and a second removable panel member;

air circulating means for propelling air through said conduit between the inlet and outlet openings and across the access opening between the conduit outlet and inlet;

means for refrigerating the air flowing through said conduit;

means at one end region of the first bottom panel member for loosely supporting one end portion of the second panel member;

support means for loosely supporting said second panel member on the bottom portion of the cabinet in spaced relation thereto;

a removable bottom shelf defining the bottom of the display space; and support means for loosely supporting said removable bottom shelf above and in spaced relation to said second panel member, said bottom shelf and second panel member being easily removable to permit access to said drain region of said cabinet.

8. A display case according to claim 7, wherein said intermediate dividing means further comprises a third relatively fixed panel member, spaced from and located on the opposite side of the drain region from the first bottom panel member; and further including quick release means securing said second panel member to said third panel member, to permit said panel member to be easily removed for access to said drain region.

9. A display case according to claim 8, further comprising: inlet grill means and grill support means for supporting said inlet grill means in a position to cover the inlet opening of said air circulation conduit; and means secured to the cabinet adjacent the conduit inlet for restraining the inlet grill means against relatively lateral inward movement toward and into the display space while freely permitting relatively vertical upward movement of the inlet grill means.

10. A refrigerated display case comprising:

a cabinet having a bottom portion which slopes downwardly to form a drain region for collecting fluid material by gravity flow;

a product display space in said cabinet and spaced from the outer walls of said cabinet, said cabinet having an access opening to permit access to the interior of the display space;

means intermediate said inner and outer cabinets for dividing the space between said cabinet and said display space into adjacent first and second conduits, each conduit having respective outlets and inlets on opposite sides of the cabinet access opening, wherein said intermediate means for dividing the space between the inner and outer cabinets comprises a first relatively fixed bottom panel member and a second removable panel member;

air circulating means for propelling air through said first and second conduits between their respective inlets and outlets and across the access opening between the respective conduit outlets and inlets;

means for refrigerating the air flowing through at least one of the first and second conduits;

means at one end region of the first bottom panel member for loosely supporting the second panel member;

support means for loosely supporting said second panel member above and in spaced relation to the bottom portion of the cabinet, to define a portion of said second conduit;

a removable bottom shelf defining the bottom of the display space;

support means for loosely supporting said removable bottom shelf above and in spaced relation to said second panel member to define a portion of said first conduit; and said bottom shelf and second panel member being easily removable to permit access to said drain region of said cabinet.

11. A display case according to claim 10, wherein said intermediate dividing means further comprises a third relatively fixed panel member, spaced from and located on the opposite side of the drain region from the first bottom panel member; and further including quick release means securing said second panel member to said third panel member, to permit said panel member to be easily removed for access to said drain region.

12. A display case according to claim 7, 8, 10 or 11, wherein said means for loosely supporting the second panel comprises a substantially U-shaped portion extending from one end of the first bottom panel member, said second panel member being slidably receivable in the groove of the U-shaped portion.

13. A display case according to claim 11, further comprising: inlet grill means and grill support means and grill support means for supporting said inlet grill means in a position to cover said first and second conduit inlets of said air circulation conduit; and means secured to the cabinet adjacent to the conduit inlets for restraining the inlet grill means against relatively lateral inward movement toward and into the display space while freely permitting relatively vertical upward movement of the inlet grill means.

14. A display case according to claim 9 or 13, wherein:

said third panel member comprises a main body portion and a further portion extending upwardly in said cabinet from said main body portion at an angle thereto;

said grill support means comprises a plurality of members secured to the upper surfaces of said main body portion and said further portion of said third panel member and having substantially L-shaped grill support faces;

said inlet grill means has a substantially complementary L-shaped portion adapted to seat loosely on said L-shaped grill support faces;

said means for loosely supporting at least a portion of the removable bottom shelf comprises a lip extending from the inlet grill means into the display space when the inlet grill means is in its operative position resting on said grill support means; and said cabinet has an opposed lip for supporting an opposite edge portion of the removable bottom shelf.

* * * * *

UNITED STATES PATENT AND TRADEMARK OFFICE

CERTIFICATE OF CORRECTION

PATENT NO. : 4,352,275

DATED : October 5, 1982

INVENTOR(S) : Fayez F. Ibrahim

It is certified that error appears in the above-identified patent and that said Letters Patent is hereby corrected as shown below:

Data sheet, Item [63], line 2, delete"abandoned".

Column 1, lines 9 and 10, "now abandoned" should be deleted.

Signed and Sealed this

*Twenty-first* Day of *February 1984*

[SEAL]

*Attest:*

GERALD J. MOSSINGHOFF

*Attesting Officer*

*Commissioner of Patents and Trademarks*